US009352918B2

(12) United States Patent
Aoki

(10) Patent No.: US 9,352,918 B2
(45) Date of Patent: May 31, 2016

(54) IMAGE RECORDING APPARATUS

(71) Applicant: BROTHER KOGYO KABUSHIKI KAISHA, Nagoya-shi, Aichi-ken (JP)

(72) Inventor: Hirotaka Aoki, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/501,555

(22) Filed: Sep. 30, 2014

(65) Prior Publication Data

US 2015/0158688 A1 Jun. 11, 2015

(30) Foreign Application Priority Data

Dec. 6, 2013 (JP) ..... 2013-252883

(51) Int. Cl.

| | |
|---|---|
| ***B65H 5/26*** | (2006.01) |
| ***B65H 1/02*** | (2006.01) |
| ***B65H 1/26*** | (2006.01) |
| ***B65H 3/06*** | (2006.01) |
| ***B65H 3/56*** | (2006.01) |
| ***B65H 5/06*** | (2006.01) |
| ***B65H 5/36*** | (2006.01) |

(52) U.S. Cl.

CPC .. *B65H 5/26* (2013.01); *B65H 1/02* (2013.01); *B65H 1/266* (2013.01); *B65H 3/0684* (2013.01); *B65H 3/56* (2013.01); *B65H 5/062* (2013.01); *B65H 5/36* (2013.01); *B65H 2402/441* (2013.01); *B65H 2402/46* (2013.01); *B65H 2404/5211* (2013.01); *B65H 2404/5214* (2013.01); *B65H 2405/324* (2013.01); *B65H 2405/332* (2013.01); *B65H 2407/21* (2013.01); *B65H 2511/162* (2013.01); *B65H 2601/11* (2013.01)

(58) Field of Classification Search

CPC ..... B65H 2407/21; B65H 2405/324; B65H 5/00; B65H 5/06; B65H 2402/441; B65H 2601/11; B65H 2402/45; B65H 2511/162; G03G 15/6514; G03G 2215/00392; G03G 2215/00544

USPC ..... 399/124

See application file for complete search history.

(56) References Cited

U.S. PATENT DOCUMENTS

| | | | | |
|---|---|---|---|---|
| 6,600,885 | B2 * | 7/2003 | Kida | 399/124 |
| 8,526,081 | B2 * | 9/2013 | Asada et al. | 358/498 |
| 8,903,274 | B2 * | 12/2014 | Ju et al. | 399/121 |
| 2005/0214027 | A1 * | 9/2005 | Yasumoto | 399/124 |
| 2014/0252713 | A1 * | 9/2014 | Masubuchi et al. | 271/10.11 |

FOREIGN PATENT DOCUMENTS

| | | | |
|---|---|---|---|
| JP | 2010-173841 | A | 8/2010 |
| JP | 2013-166623 | A | 8/2013 |

* cited by examiner

*Primary Examiner* — Jeremy R Severson

(74) *Attorney, Agent, or Firm* — Merchant & Gould P.C.

(57) ABSTRACT

An image recording apparatus includes: a first tray on which a sheet is to be placed, a case having a first conveyance path extending from the first tray, a feed roller to feed the sheet from the first tray, a conveyance roller to convey the sheet through the first conveyance path, a recording unit to record an image on the sheet conveyed through the first conveyance path, a first guide member pivotable between a first position defining an outside of a curved portion of the first conveyance path and a second position opening the curved portion of the first conveyance path, a second guide member defining an inside of the curved portion of the first conveyance path, and a third guide member pivotably provided at the side of a pivot front-end of the first guide member to pivot between a third position and a fourth position.

8 Claims, 10 Drawing Sheets

IMAGE RECORDING APPARATUS

CROSS REFERENCE TO RELATED APPLICATION

The present application claims priority from Japanese Patent Application No. 2013-252883 filed on Dec. 6, 2013 the disclosure of which is incorporated herein by reference in its entirety.

BACKGROUND

1. Field of the Invention

The present invention relates to an image recording apparatus which conveys sheets along a conveyance path and carries out image recording.

2. Description of the Related Art

An image recording apparatuses, which is provided with a conveyance path inside a case of the apparatus and which records image on a sheet conveyed along the conveyance path, is known. The image recording apparatus has a paper feed cassette which supports a plurality of such sheets and a manual feed tray which is provided separately from the paper feed cassette and guides sheets into the conveyance path.

Further, an image recording apparatus, which is provided with a guide member defining a U-turn conveyance path, is known. In such an image recording apparatus, for the purposes of maintenance and clearing a paper jam, the guide member is constructed of a nonrotating (fixed) guide member and a rotatable guide member rotatable around a rotating shaft. This rotatable guide member has an approximate L-shape in a side view along the rotating shaft. According to this configuration, if a user rotates a part of the rotatable guide member to open the U-turn conveyance path, then it is possible for the user to access, from the outside, the U-turn conveyance path inside the image recording apparatus.

SUMMARY

In an image recording apparatus provided with both the manual feed tray and the guide member (which constitutes a part of the U-turn conveyance path and which is rotatable) which are mentioned above, if the manual feed tray is arranged within a rotating trajectory of the guide member, the guide member collides with the manual feed tray when the guide member is rotated. Therefore, the manual feed tray cannot be arranged within the rotating trajectory of the guide member. Namely, there is restriction on the layout of each member, thereby giving rise to such a problem that it is not possible to reduce the overall size of the image recording apparatus.

Further, if the rotatable guide member is downsized so as not to collide with the manual feed tray, then another problem may arise. Downsizing the rotatable guide member results in shortening the radius of the rotating trajectory of the rotatable guide member. In other words, it means shortening the distance from the rotating center to the farthest part of the rotatable guide member. As described above, because the rotatable guide member has an approximate L-shape in a side view along the rotating shaft, the farthest part from the rotating center is considered to be the part provided at the farthest end of the guide surface for guiding the conveyed sheet (the terminal of the short side of the L-shape when the terminal of the long side of the L-shape is taken as the rotating center). Therefore, shortening the distance from the rotating center to the farthest part means shortening the short side of the L-shape. That is, in the conveyance path defined by the nonrotating (fixed) guide member and the rotatable guide member inside the image recording apparatus, a commissure or seam between the nonrotating guide member and the rotatable guide member becomes wider, and it is feared that a smooth conveyance of sheets is difficult to be realized.

The present teaching is made in view of the above problems, and an object thereof is to provide a means for lessening the rotating trajectory of the guide member while reducing the influence on conveyance of sheets.

According to an aspect of the present teaching, there is provided an image recording apparatus including: a first tray on which a sheet is to be placed; a case in which a first conveyance path is formed, the first conveyance path including a curved portion curved upward from the first tray and an extended portion connected to the curved portion; a feed roller configured to feed the sheet from the first tray along the first conveyance path in a conveyance direction; a conveyance roller arranged at downstream side of the feed roller in the conveyance direction in the first conveyance path, and configured to convey the sheet; a recording unit arranged at downstream side of the conveyance roller in the conveyance direction in the first conveyance path, and configured to record an image on the sheet conveyed through the extended portion of the first conveyance path; a first guide member arranged at upstream side of the conveyance roller in the conveyance direction, configured to define an outside of the curved portion of the first conveyance path, and configured to be pivotable between a first position at which the curved portion is defined by the first guide and a second position at which the curved portion is opened by the first guide, with an upstream side portion in the conveyance direction thereof as a first pivot shaft and with a downstream side portion in the conveyance direction thereof as a first pivot front-end; a second guide member configured to define an inside of the curved portion of the first conveyance path; and a third guide member provided for the first guide member at a position on a side of the first pivot front-end, configured to be pivotable between a third position and a fourth position, and having a second pivot front-end projecting in the conveyance direction from the first pivot front-end of the first guide member, wherein in a state that the third guide member is positioned at the third position, the second pivot front-end is positioned at an inner side of a curvature with respect to the first guide member, and a distance from the second pivot front-end to the first pivot shaft in a state that the third guide member is positioned at the fourth position is longer than a distance from the second pivot front-end to the first pivot shaft in the state that the third guide member is positioned at the third position.

In a state that the first guide member is situated at the first position, if the sheet is supplied from the first tray to the first conveyance path, then the sheet is conveyed between the first guide member and the second guide member, that is, conveyed through the curved portion. The front end of the sheet conveyed through the curved portion contacts with the third guide member. The third guide member is maintained at the fourth position by contact with the sheet. The sheet is guided by the third guide member at the fourth position to the downstream side in the conveyance direction from the pivot front-end of the first guide member.

When the first guide member is pivoted from the first position to the second position, the third guide member is pivoted from the fourth position to the third position, thereby shortening the trajectory for the first guide member to pivot therethrough. Here, inner side of a curvature with respect to the first guide member means inner side of a curvature of the curved portion in a case that the first guide member is positioned at the first position.

DESCRIPTION OF THE PREFERRED EMBODIMENT

Figure 1:
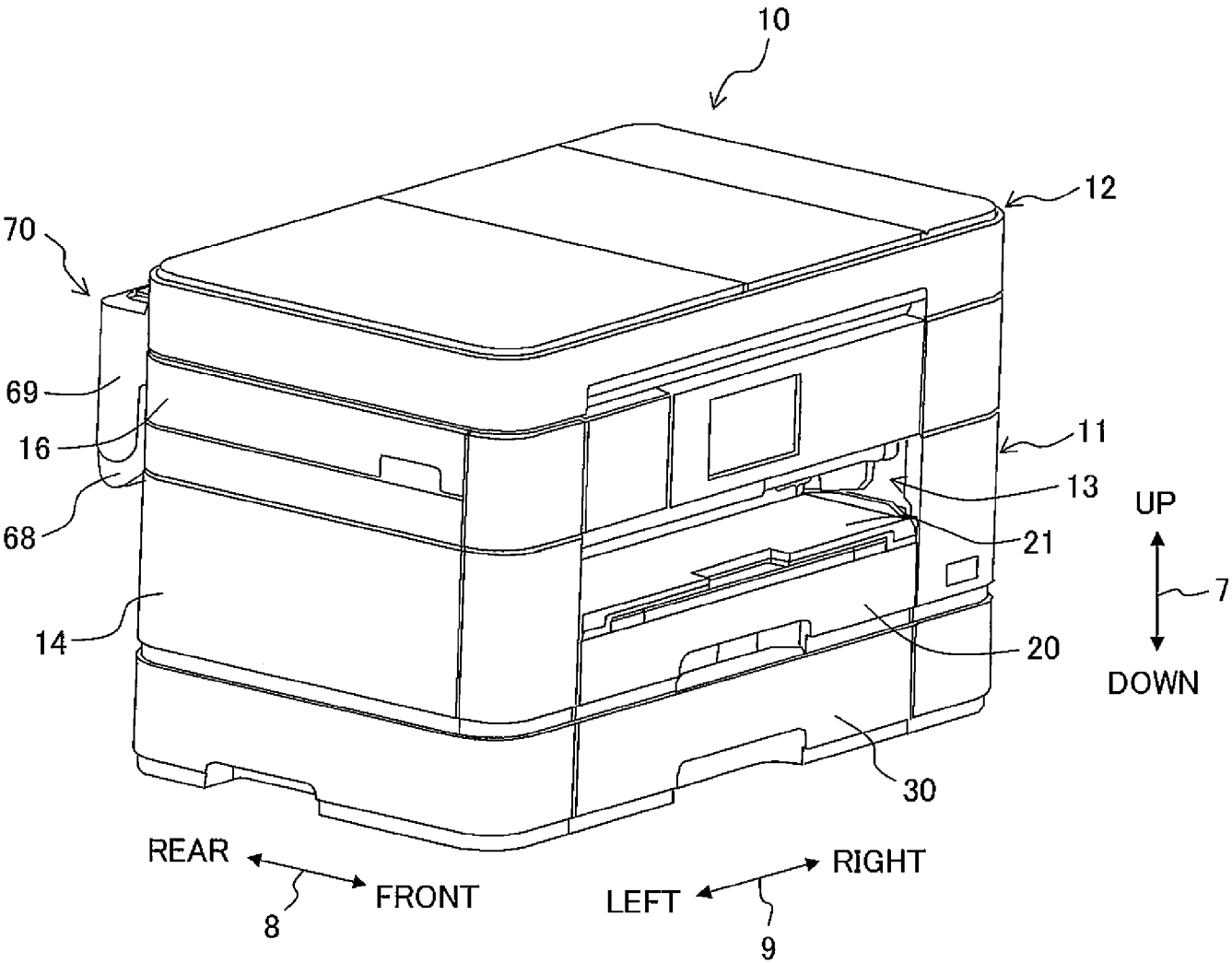
FIG. 1 is a perspective view depicting a front side of a multifunction peripheral in which a movable portion is in a stand-up state.

Hereinbelow, a multifunction peripheral 10 according to an embodiment of the present teaching will be described. Further, it is needless to say that the embodiment described below is merely one example of the present teaching, and thus it is possible to change the embodiment as appropriate within a range without changing the gist or essential characteristics of the present teaching. In the following description, an up-down direction 7 is defined with reference to a state (state depicted in FIG. 1) in which the multifunction peripheral 10 is operably placed, a front-rear direction 8 is defined with reference to that a portion of the multifunction peripheral 10 on which an opening 13 is provided is a near side (front side), and a left-right direction 9 is defined with reference to a view from a view point in front of the multifunction peripheral 10.

<Overall Construction of Multifunction Peripheral 10>

Figure 2:
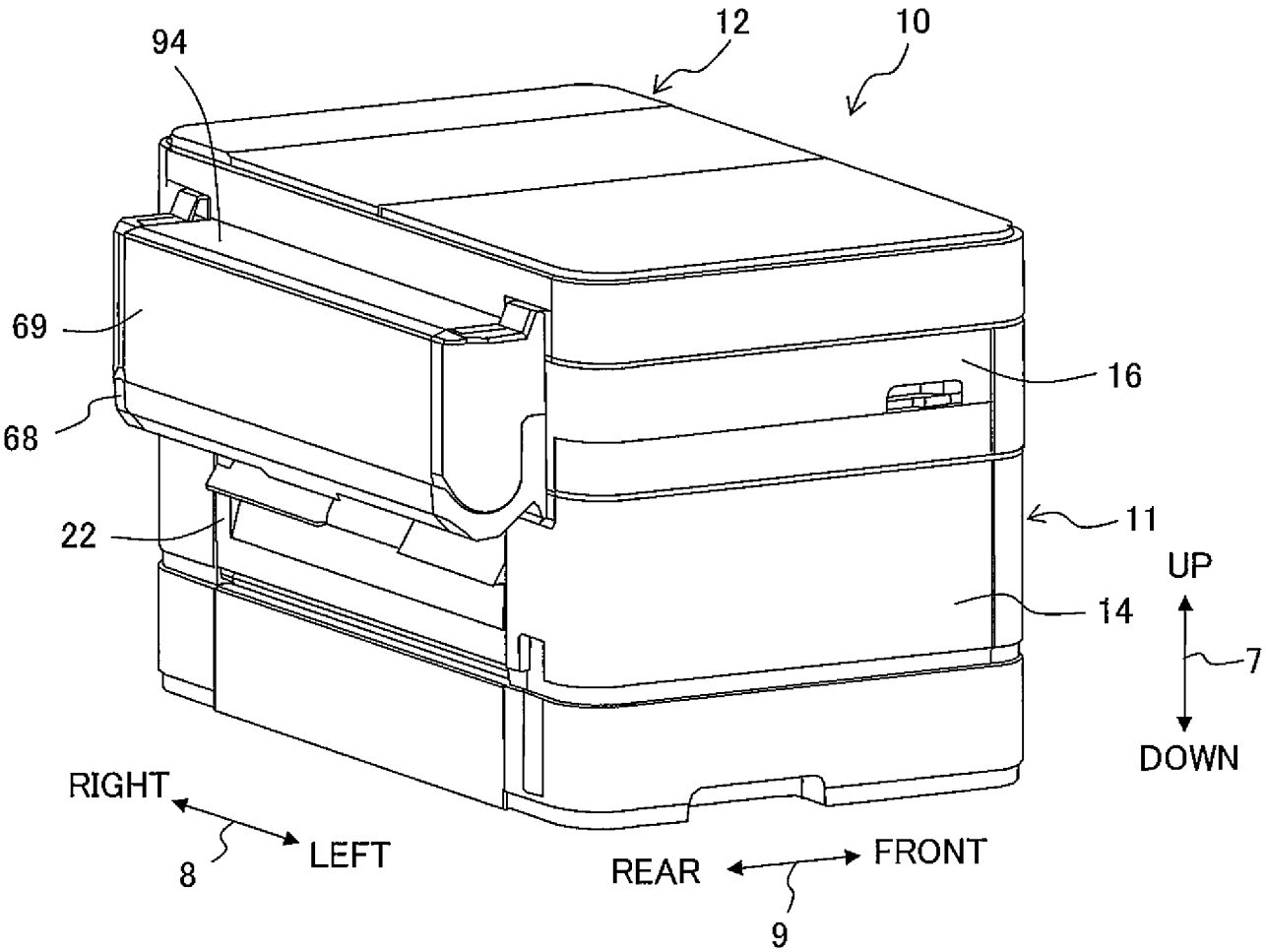
FIG. 2 is a perspective view depicting a rear side of the multifunction peripheral in which the movable portion is in the stand-up state.
Figure 3:
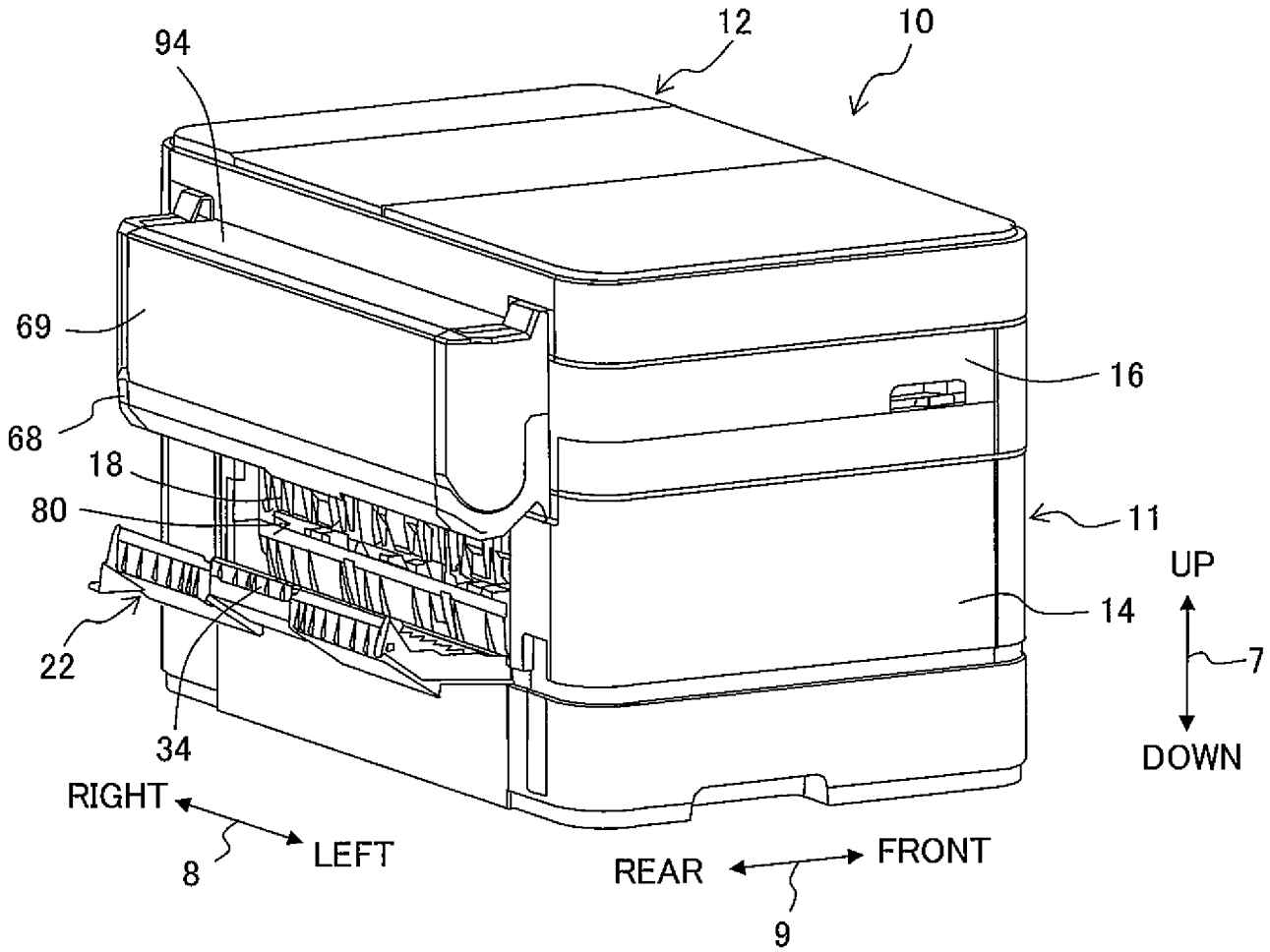
FIG. 3 is a perspective view depicting the rear side of the multifunction peripheral in which a guide member is in a lie-down state.

As depicted in FIG. 1 to FIG. 3, the multifunction peripheral 10 is formed to have a generally rectangular parallelepiped shape, and provided with a printer unit 11 which records image on a recording sheet by an ink-jet recording method. The multifunction peripheral 10 has a variety of functions such as a facsimile function, a print function, and the like. The printer unit 11 corresponds to the image recording apparatus.

The printer unit 11 has a casing 14 having the opening 13 formed on the front. A feed tray 20 capable of loading the recording sheet of various sizes and a discharge tray 21 are provided to be insertable into and removable from the opening 13 in the front-rear direction 8. A feed cassette 30 is provided below the feed tray 20. The feed cassette 30 is capable of loading the recording sheet of various sizes, independently from the feed tray 20. The bottom surface of the feed cassette 30 contacts with an installation surface on which the multifunction peripheral 10 is placed.

Figure 4:
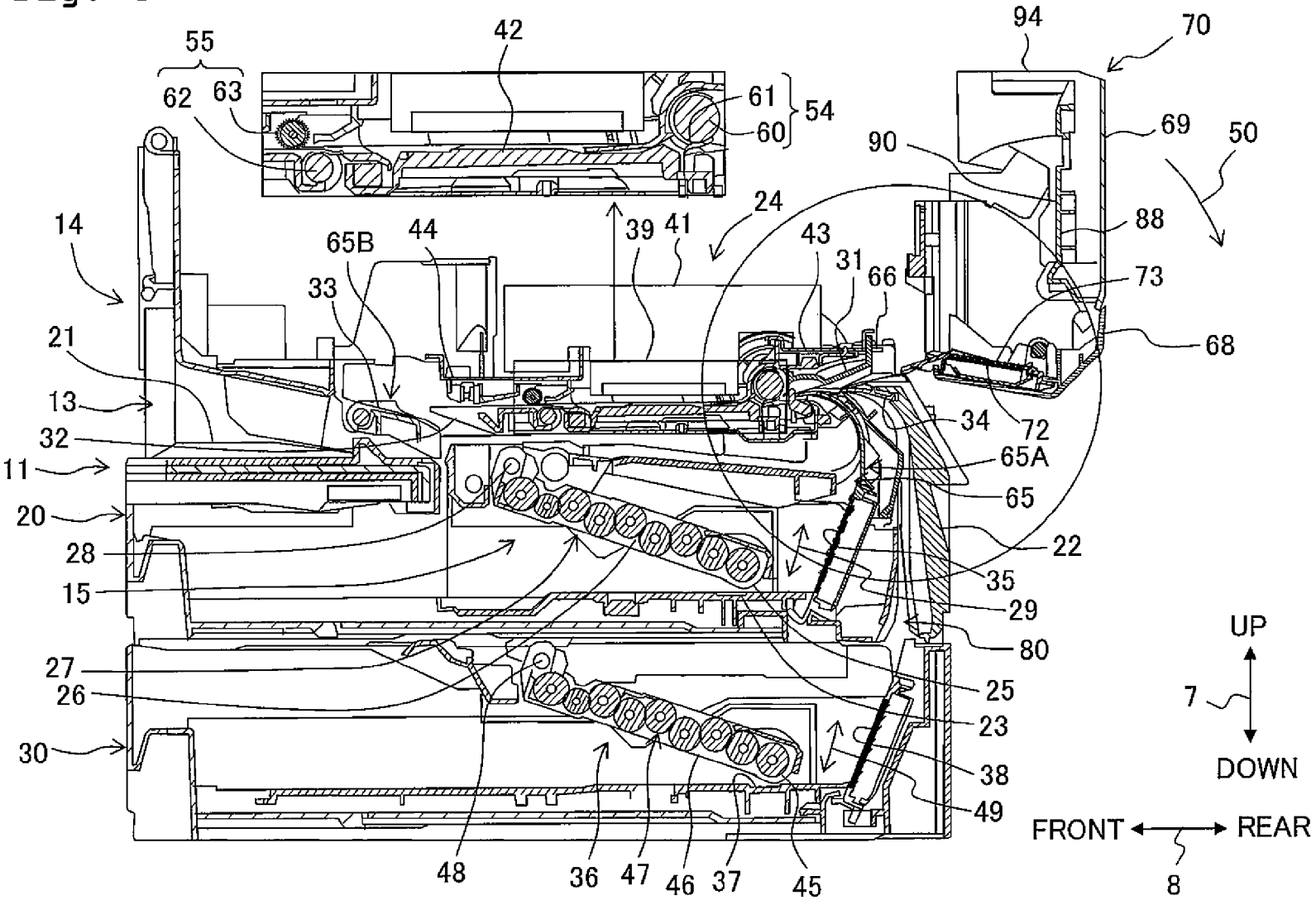
FIG. 4 is a vertical cross-sectional view depicting an internal structure of a printer unit.

As depicted in FIG. 4, the printer unit 11 includes a feed unit 15 which feeds the recording sheet from the feed tray 20, a feed unit 36 which feeds the recording sheet from the feed cassette 30, a recording unit 24 which records image on the recording sheet, a first conveyance roller pair 54 and a second conveyance roller pair 55 which convey the recording sheet, etc.

As depicted in FIG. 1 to FIG. 3, a scanner unit 12 is provided on the printer unit 11. The scanner unit 12 has a casing 16. The dimensions in the front-rear direction 8 and in the left-right direction 9 of the casing 16 are same as those of the casing 14 of the printer unit 11. Therefore, the casing 14 of the printer unit 11 and the casing 16 of the scanner unit 12 are integrated into one body to form the generally rectangular parallelepiped outer shape of the multifunction peripheral 10. The scanner unit 12 is a flatbed scanner. Because the flatbed scanner has a publicly known structure, any detailed explanation therefore will be omitted herein. Further, the scanner unit 12 may be provided with an automatic document feeder (ADF) which separates a plurality of sheets of an original document and feeds the sheets one by one.

<Printer Unit 11>

A detailed structure of the printer unit 11 will be described below.

<Feed Tray 20>

The feed tray 20 has a box-like shape with an open top. In the feed tray 20, length in the front-rear direction 8 is longer than length in the up-down direction 7 and length in the left-right direction 9 is longer than the length in the up-down direction 7. The discharge tray 21 is provided at a front part of the feed tray 20. The feed tray 20 is capable of loading various sizes of recording sheets such as, for example, from the A4 size according to Japanese Industrial Standards to the L (large) size used in photographic recording, by supporting the recording sheets on a support surface thereof. The feed tray 20 is housed in an internal space leading to the opening 13 of the casing 14. The feed tray 20 can move frontward and rearward along the front-rear direction 8 with respect to the casing 14 via the opening 13.

<Feed Unit 15>

As depicted in FIG. 4, the feed unit 15 includes a feed roller 25, a feed arm 26, a driving force transmission mechanism 27, and a separating pad 23. The feed unit 15 is provided above the feed tray 20 and below the recording unit 24. The feed roller 25 is rotatably supported by a shaft at a fore-end portion of the feed arm 26. The feed arm 26 pivots in a direction indicated by the arrow 29 around a shaft 28 provided at its base end. In association with the pivot of the feed arm 26, the feed roller 25 comes to contact with or depart from the support surface of the feed tray 20. Therefore, in a state that the feed tray 20 in which the recording sheet is loaded is installed in the casing 14, the feed roller 25 is contactable with the recording sheet loaded in the feed tray 20. The separating pad 23 is provided in a position at which the feed roller 25 contacts with the support surface of the feed tray 20, in a state that the feed tray 20 in which the recording sheet is not loaded is installed in the casing 14. The separating pad 23 is formed of a material having a greater friction coefficient with respect to the recording sheet than that of the support surface of the feed tray 20.

A driving force is transmitted from a motor (not depicted) to the feed roller 25 via the driving force transmission mechanism 27. The driving force transmission mechanism 27 transmits the rotation transmitted to the shaft 28 to the shaft of the feed roller 25 through a gear row formed of a plurality of engaged gears. The feed roller 25 feeds the recording sheet to a conveyance path 65 by rotating in such a state in which the feed roller 25 contacts with the topmost sheet of the recording sheets supported on the support surface of the feed tray 20. When the recording sheet is fed to the conveyance path 65, the anterior end of the recording sheet comes to contact with a separating member 35 provided at a rear part in the front-rear direction 8 of the feed tray 20. As a result, only the topmost sheet is separated from underlaid sheets of the recording sheets and conveyed. Thus, the underlaid sheets in contact with the separating member 35 are retained and loaded as they are in the feed tray 20 without being entrained by the topmost sheet.

<Feed Cassette 30>

The feed cassette 30 has a box-like shape with an open top. In the feed cassette 30, length in the front-rear direction 8 is longer than length in the up-down direction 7, and length in the left-right direction 9 is longer than the length in the up-down direction 7. The feed cassette 30 has almost the same outer shape as the feed tray 20 in the front-rear direction 8 and in the left-right direction 9, and is arranged below the feed tray 20. The feed cassette 30 is capable of loading various sizes of recording sheets such as, for example, from the A4 size according to Japanese Industrial Standards to the L (large) size used in photographic recording, by supporting the recording sheets on a support surface thereof. The feed cassette 30 can move frontward and rearward along the front-rear direction 8 with respect to the casing 14. The feed cassette 30 corresponds to the first tray.

<Feed Unit 36>

As depicted in FIG. 4, the feed unit 36 includes a feed roller 45, a feed arm 46, a driving force transmission mechanism 47, and a separating pad 37. The feed unit 36 is provided below the feed tray 20 and above the feed cassette 30. The feed roller 45 is rotatably supported by a shaft at a fore-end portion of the feed arm 46. The feed arm 46 pivots in a direction indicated by the arrow 49 around a shaft 48 provided at its base end. By virtue of this, the feed roller 45 comes to contact with or depart from the support surface of the feed cassette 30. Therefore, when the feed cassette 30 on which the recording sheet is placed is installed in the casing 14, the feed roller 45 is contactable with the recording sheet loaded in the feed cassette 30. The separating pad 37 is provided in a position at which the feed roller 45 contacts with the support surface of the feed cassette 30 when the feed cassette 30 on which the recording sheet is not placed is installed in the casing 14. The separating pad 37 is formed of a material having a greater friction coefficient with respect to the recording sheet than that of the support surface of the feed cassette 30.

A driving force is transmitted from a motor (not depicted) to the feed roller 45 via the driving force transmission mechanism 47. The driving force transmission mechanism 47 transmits the rotation transmitted to the shaft 48 to the shaft of the feed roller 45 through a gear row formed of a plurality of engaged gears. The feed roller 45 feeds the recording sheet to a conveyance path 80 by rotating in such a state in which the feed roller 45 contacts with the topmost sheet of the recording sheets supported on the support surface of the feed cassette 30. When the recording sheet is fed to the conveyance path 80, the anterior end of the recording sheet comes to contact with a separating member 38 provided at a rear part in the front-rear direction 8 of the feed cassette 30. As a result, only the topmost sheet is separated from underlaid sheets of the recording sheets and conveyed. Thus, the underlaid sheets in contact with the separating member 38 are retained and loaded as they are in the feed cassette 30 without being entrained by the topmost sheet.

<Conveyance Path 65>

As depicted in FIG. 4, the conveyance path 65 provided in the internal space of the casing 14 extends from the rear side of the feed tray 20 and curves upward to make a U-turn and, after curving frontward from the rear side of the printer unit 11, further extends almost straight toward the front side to reach the discharge tray 21. The conveyance path 65 is divided roughly into a curved pathway 65A to make the U-turn, and a straight pathway 65B. The straight pathway 65B corresponds to the extended portion.

The curved pathway 65A is defined by an outer guide member 18, an inner guide member 19 and a guide member 31. The outer guide member 18 and the guide member 31 face the inner guide member 19 while keeping a space therebetween so that a recording sheet can pass through the space. The straight pathway 65B is defined by the recording unit 24 and a platen 42 as well as by a guide member 32 and a guide member 33. The recording unit 24 faces the platen 42 and the guide member 32 faces the guide member 33 while keeping a space therebetween so that a recording sheet can pass through the space.

When the recording sheet is fed along the conveyance path 65 by the feed roller 25 of the feed tray 20, its conveyance direction is reversed by being conveyed from the downside toward the upside along the curved pathway 65A, and then the recording sheet is conveyed from the rear side toward the front side along the straight pathway 65B without reversing the conveyance direction.

The outer guide member 18 serves as an outer guide surface when the recording sheet is conveyed along the curved pathway 65A. The inner guide member 19 serves as an inner guide surface when the recording sheet is conveyed along the curved pathway 65A. Further, each of the guide surfaces may be constructed of one surface or be constructed of a group of fore-end surfaces of a plurality of ribs.

The guide member 31 is arranged above the inner guide member 19 at an upstream side (rear side) of the first conveyance roller pair 54. The outer guide member 18 and the guide member 31 are also the members defining a bypass path 66 which will be described later.

<Conveyance Path 80>

As depicted in FIG. 4, the conveyance path 80 provided in the internal space of the casing 14 extends from the rear side of the feed cassette 30 and curves upward to make a U-turn, and is connected to the conveyance path 65 at an immediately upstream side (rear side) of the first conveyance roller pair 54. The conveyance path 80 corresponds to the curved portion. Further, a first conveyance path is formed by the conveyance path 80, and the straight pathway 65B of the conveyance path 65.

The conveyance path 80 is defined by the outer guide member 18 and a guide member 22. The outer guide member 18 and the guide member 22 face each other while keeping a space therebetween so that a recording sheet can pass through the space. While the outer guide member 18 defines an outside of a curvature of the curved pathway 65A of the conveyance path 65, a surface of the outer guide member 18 on outer side of the curvature defines an inside of a curvature of the conveyance path 80. The guide member 22 defines an outside of a curvature of the conveyance path 80. A detailed configuration of the guide member 22 will be described later. The outer guide member 18 corresponds to the second guide member.

When the recording sheet is fed by the feed roller 45 from the feed cassette 30 along the conveyance path 80, its conveyance direction is reversed from the downside toward the upside, and the recording sheet comes into the conveyance path 65 at immediately upstream of the first conveyance roller pair 54.

<First Conveyance Roller Pair 54 and Second Conveyance Roller Pair 55>

As depicted in FIG. 4, in the conveyance path 65, the first conveyance roller pair 54 is provided on an upstream side of the recording unit 24 in the conveyance direction (frontward direction in the front-rear direction 8). The first conveyance roller pair 54 has a first conveyance roller 60 and a pinch roller 61. In the conveyance path 65, the second conveyance roller pair 55 is provided on a downstream side of the recording unit 24 in the conveyance direction. The second conveyance roller pair 55 has a second conveyance roller 62 and a spur roller 63. A rotation of a motor (not depicted) is transmitted to the first conveyance roller 60 and the second conveyance roller 62 to rotate the same. The first conveyance roller pair 54 and the second conveyance roller pair 55 convey the recording sheet by the rotations of the first conveyance roller 60 and the second conveyance roller 62 while nipping the recording sheet between the first conveyance roller 60 and the pinch roller 61 and between the second conveyance roller 62 and the spur roller 63. The first conveyance roller 60 corresponds to the conveyance roller.

<Recording Unit 24>

As depicted in FIG. 4, the recording unit 24 is provided between the first conveyance roller pair 54 and the second conveyance roller pair 55. The recording unit 24 includes a carriage 41 and a recording head 39. The carriage 41 is supported by guide rails 43 and 44 provided on the rear side and the front side of the platen 42 respectively, to reciprocate in the left-right direction 9. The guide rail 44 is provided with a publicly known belt mechanism. The carriage 41 is linked to an endless belt of the belt mechanism, and caused to reciprocate in the left-right direction 9 along the guide rails 43 and 44 when the endless belt is driven to run. When the carriage 41 and the recording head 39 are facing the platen 42 while keeping a space therebetween, the carriage 41, the recording head 39, and the platen 42 define a part of the straight pathway 65B.

The recording head 39 is mounted on the carriage 41. A plurality of nozzles (not depicted) are formed in a lower surface of the recording head 39. The recording head 39 is supplied with ink from an ink cartridge (not depicted). The recording head 39 selectively ejects the ink as tiny ink droplets from the plurality of nozzles. When the carriage 41 is moving in the left-right direction 9, the ink droplets are ejected from the nozzles onto the recording sheet supported by the platen 42. An image is recorded on the recording sheet by letting the ejected ink droplets adhere to the recording sheet on the platen 42.

<Bypass Path 66>

An opening 64 is provided above the guide member 22 on the rear side of the casing 14. Inside the casing 14, the bypass path 66 is formed to extend from the opening 64 to the first conveyance roller pair 54. The bypass path 66 is a pathway extending inside the casing 14 obliquely downward from the rear side to the front side in the front-rear direction 8. The bypass path 66 is defined by the guide member 31, the outer guide member 18, and the guide member 22. The guide member 31 serves as the upper guide surface when the recording sheet is conveyed along the bypass path 66. The outer guide member 18 and the guide member 22 serve as the lower guide surface when the recording sheet is conveyed along the bypass path 66. The curved pathway 65A and the straight pathway 65B of the conveyance path 65, as well as the conveyance path 80, are arranged below the bypass path 66. As the outer guide member 18 and the guide member 22 pivot in such a manner that their upper end portions fall rearward, a part of the bypass path 66, together with a part of the conveyance path 65 and a part of the conveyance path 80, is opened (exposed) to the outside of the casing 14.

The recording sheet placed on an aftermentioned bypass tray 70 is guided obliquely downward along the bypass path 66. That recording sheet is guided along the straight pathway 65B of the conveyance path 65 to be conveyed by the first conveyance roller pair 54. Further, an image is recorded on the recording sheet by the recording unit 24, and then the recording sheet is discharged to the discharge tray 21. In this manner, the recording sheet placed on the bypass tray 70 is conveyed along an almost straight path (a path in which the front surface and rear surface of the recording sheet do not turn over in the up-down direction 7). The bypass path 66 corresponds to the second conveyance path.

<Bypass Tray 70>

As depicted from FIG. 1 to FIG. 4, the bypass tray 70 is provided in a rear part of the multifunction peripheral 10. The bypass tray 70 loads recording sheet independently from the feed tray 20. The bypass tray 70 corresponds to the second tray.

Figure 7:
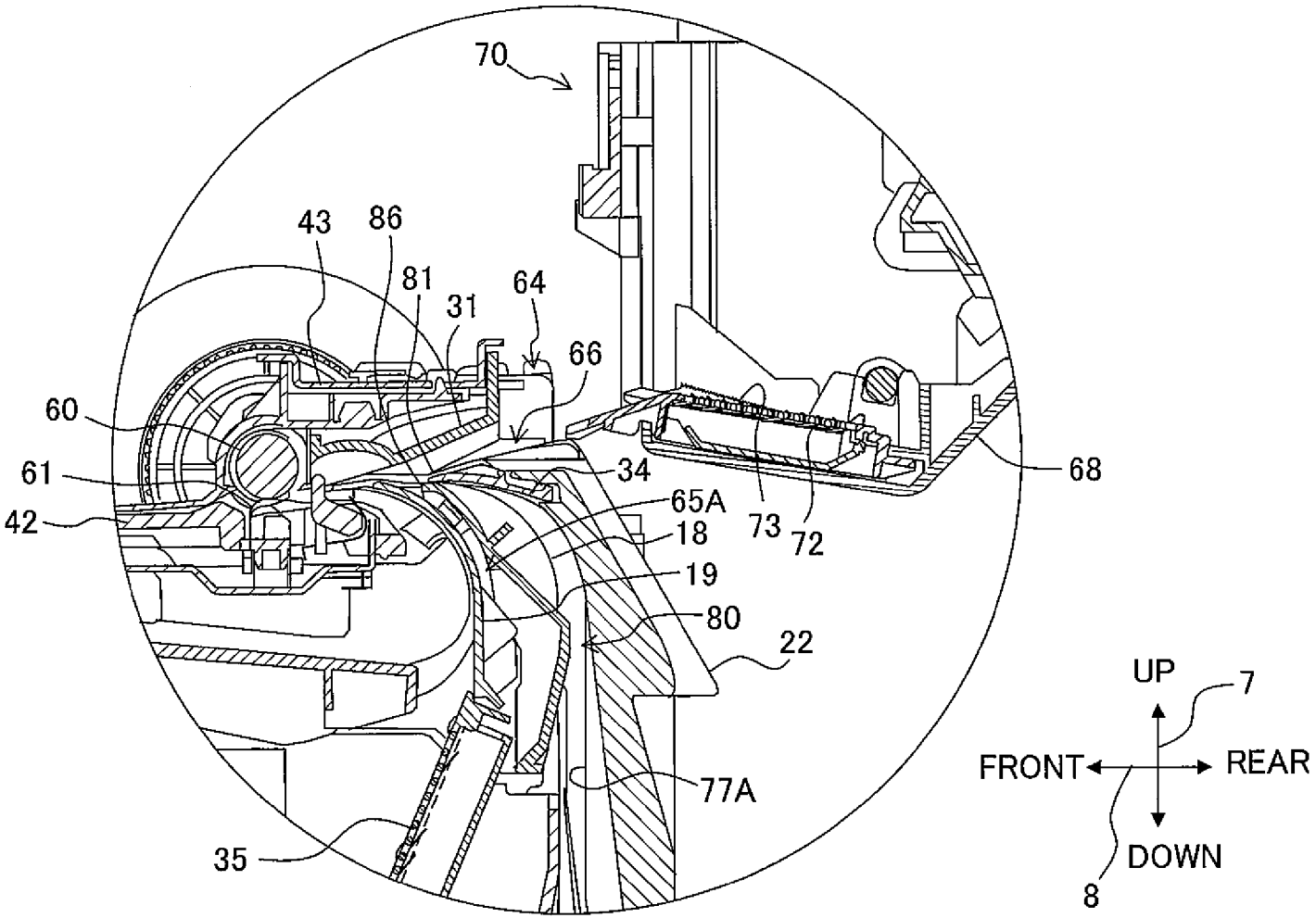
FIG. 7 is an enlarged view depicting a vicinity of the guide member in FIG. 4.
Figure 8:
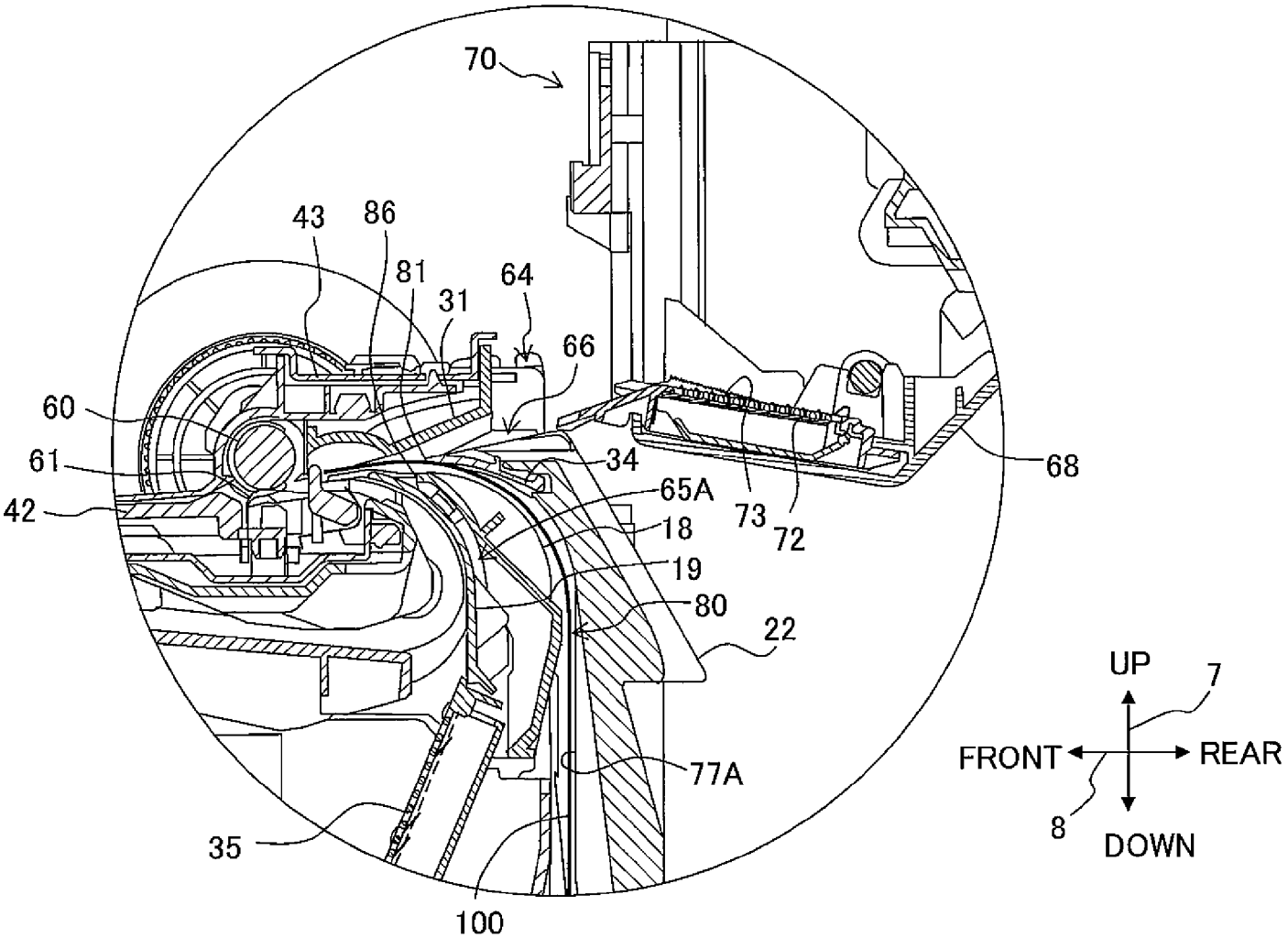
FIG. 8 is an enlarged view depicting the vicinity of the guide member in FIG. 4 when a recording sheet is passing through the guide member.
Figure 9:
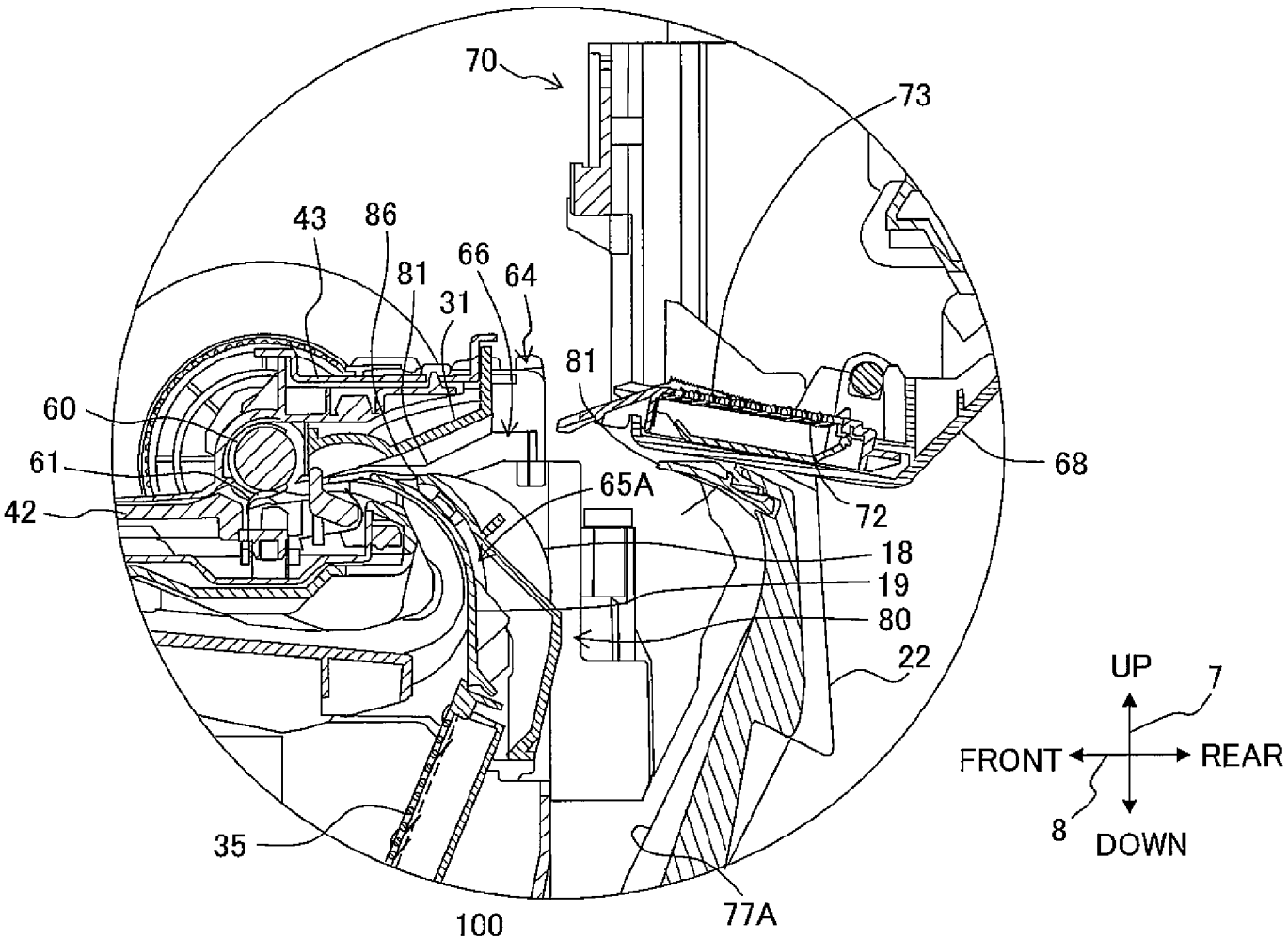
FIG. 9 is an enlarged view depicting the vicinity of the guide member in FIG. 4 when the guide member is rotated from the stand-up state to the lie-down state.

A fixed portion 68 is provided on the rear side of the casing 14 extending downward to cover the opening 64 (see FIG. 7 to FIG. 9). The fixed portion 68 constitutes a part of the bypass tray 70 on the downstream side in the conveyance direction. As depicted in FIG. 4, a movable portion 69 is provided above the fixed portion 68 to be pivotable with respect to the fixed portion 68. The bypass tray 70 is constructed by the fixed portion 68 and the movable portion 69.

A separation member 72 is provided below the fixed portion 68. The separation member 72 is positioned at almost the same height as the opening 64 in the up-down direction 7. The separation member 72 has an upper surface against which the forward end of the recording sheet supported by the bypass tray 70 abuts. A plurality of teeth 73 protrude upwardly (see FIG. 4 and FIGS. 7 to 9) from the upper surface of the separation member 72 while being aligned in the front-rear direction 8. The teeth 73 are used to separate the forward ends of a plurality of recording sheets supported by the bypass tray 70.

The movable portion 69 is provided above the fixed portion 68 to be pivotable with respect to the fixed portion 68. As depicted in each of the drawings, the movable portion 69 is pivotable between a stand-up state in which a support surface 90 of a support member 88 stands up along the up-down direction 7, and an inclined state (not depicted) in which the support surface 90 is inclined with respect to the up-down direction 7 after pivoting in a direction indicated by the arrow 50 (see FIG. 4) from the stand-up state. The stand-up state is a state for reducing the space for the movable portion 69 at the rear side of the casing 14, and a state in which the bypass tray 70 is not usable. In the stand-up state, a rear surface of the movable portion 69 is almost parallel to the rear surface of the casing 14. The inclined state is a state in which the movable portion 69 is inclined obliquely upward toward the outside of the casing 14, and a state in which the bypass tray 70 is usable. It is possible to select either the stand-up state or the inclined state for the movable portion 69 by an operation of the user.

A tray cover 94 is provided at an upper end of the movable portion 69. The tray cover 94 is provided to be pivotable with respect to a support member 88 around a shaft (not depicted) extending along the left-right direction 9. The tray cover 94 is a flatplate member capable of sealing an opening of the bypass tray 70 on the upper end side so as to cover up a space defined on a side of a support surface 90.

As depicted in each of the drawings, when the movable portion 69 is in the stand-up state, the tray cover 94 is pivotable to the position at which the opening of the bypass tray 70 on the upper end side thereof is covered by the tray cover 94. Further, when the movable portion 69 is in the inclined state, the tray cover 94 is pivotable to a position at which the opening of the bypass tray 70 on the upper end side thereof is uncovered by the tray cover 94. When the tray cover 94 is positioned at the position of releasing the upper end side of the bypass tray 70 with respect to the movable portion 69 in the inclined state, the tray cover 94 extends obliquely upward to lengthen the support surface 90, thereby being able to support the upper end side of the recording sheet projecting from the support surface 90.

Although not depicted in the respective drawings, the bypass tray 70 is provided with a feed unit similar to the feed unit 15. That is, in a state that the movable portion 69 is in the inclined state, a feed roller supported by an arm on a front-end side thereof is provided above the support surface 90, and a driving force is transmitted from a motor to rotate the feed roller, thereby feeding, to the bypass path 66, the topmost sheet of the recording sheets supported by the support surface 90 of the bypass tray 70. Then, recording sheets laid under the topmost recording sheet are separated by the teeth 73 of the separating piece 72, and retained in the bypass tray 70 without being entrained by the topmost recording sheet.

<Guide Member 22>

As depicted from FIG. 2 to FIG. 4, the guide member 22 is supported to be pivotable with respect to the casing 14 to constitute a part of the rear surface of the casing 14. The guide member 22 is supported by the casing 14 via shafts 76 (see FIGS. 5A and 5B, and FIG. 6) provided on left end and right end at lower part thereof. When the guide member 22 is pivoted around the shafts 76 with respect to the casing 14, that is, when the guide member 22 is pivoted so that the upper side thereof (pivot front-end side) falls rearward with respect to the casing 14 as depicted in FIG. 3, a part of the conveyance path 80 and a part of the bypass path 66 are opened (exposed) to the outside of the casing 14. The guide member 22 corresponds to the first guide member and the shafts 76 correspond to the first pivot shaft.

As with the guide member 22, the outer guide member 18 is also supported to be pivotable with respect to the casing 14 via shafts on left end and right end at lower part thereof. As depicted in FIG. 3, in an open state in which the guide member 22 falls rearward, the outer guide member 18 is also pivotable around pivot shafts (not depicted) extending along the left-right direction 9 at lower part thereof so that the upper side thereof falls rearward. Although not depicted in the drawings, when the outer guide member 18 is pivoted to fall rearward, at least a part of the curved pathway 65A is opened (exposed) to the outside of the casing 14. As depicted in FIG. 2, if the guide member 22 is closed to come into the stand-up state, then the outer guide member 18 is supported by the guide member 22 from the rear side to be maintained in the stand-up state, thereby facing the inner guide member 19 to define the curved pathway 65A. With respect to the guide member 22, the stand-up state corresponds to the first position, and the open state corresponds to the second position.

Figure 5A:
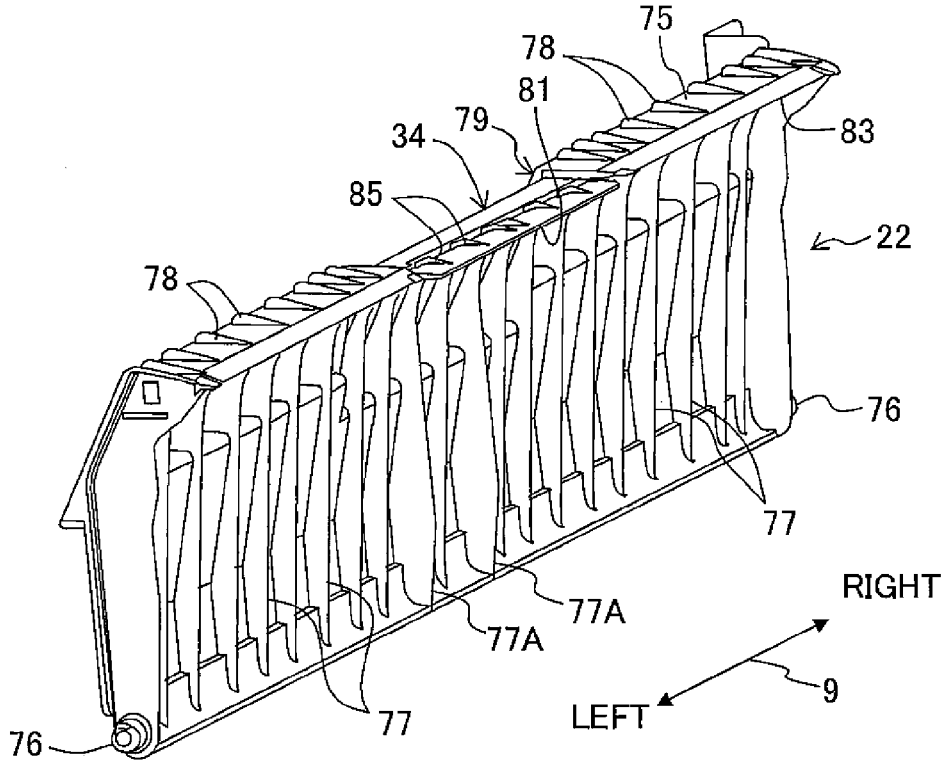
FIGS. 5A and 5B are perspective views depicting an inner side of a curvature of the guide member.
Figure 5B:
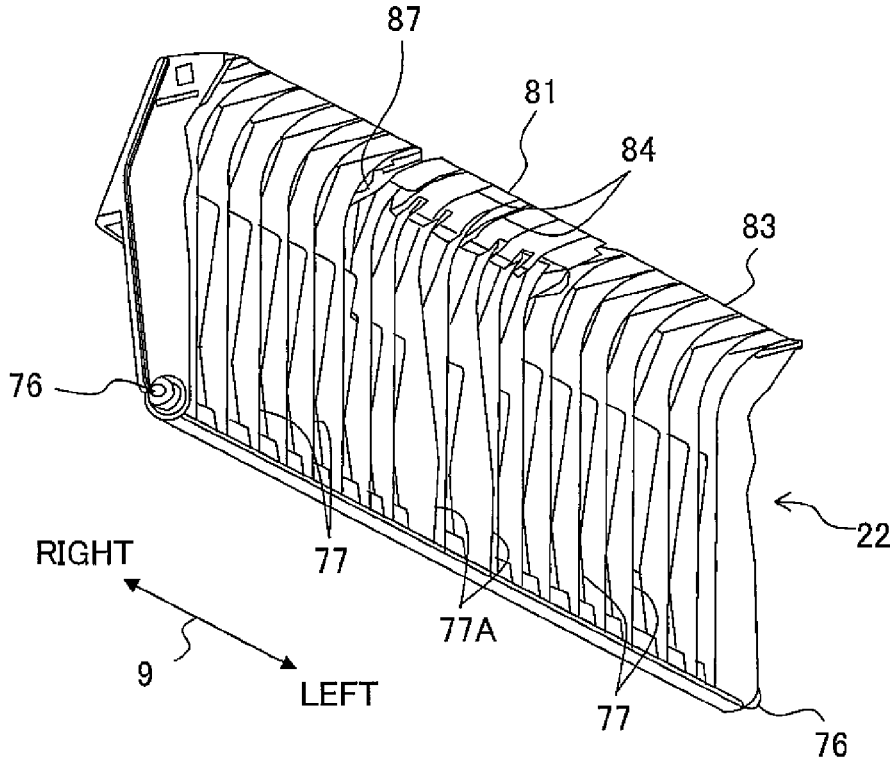
Figure 6:
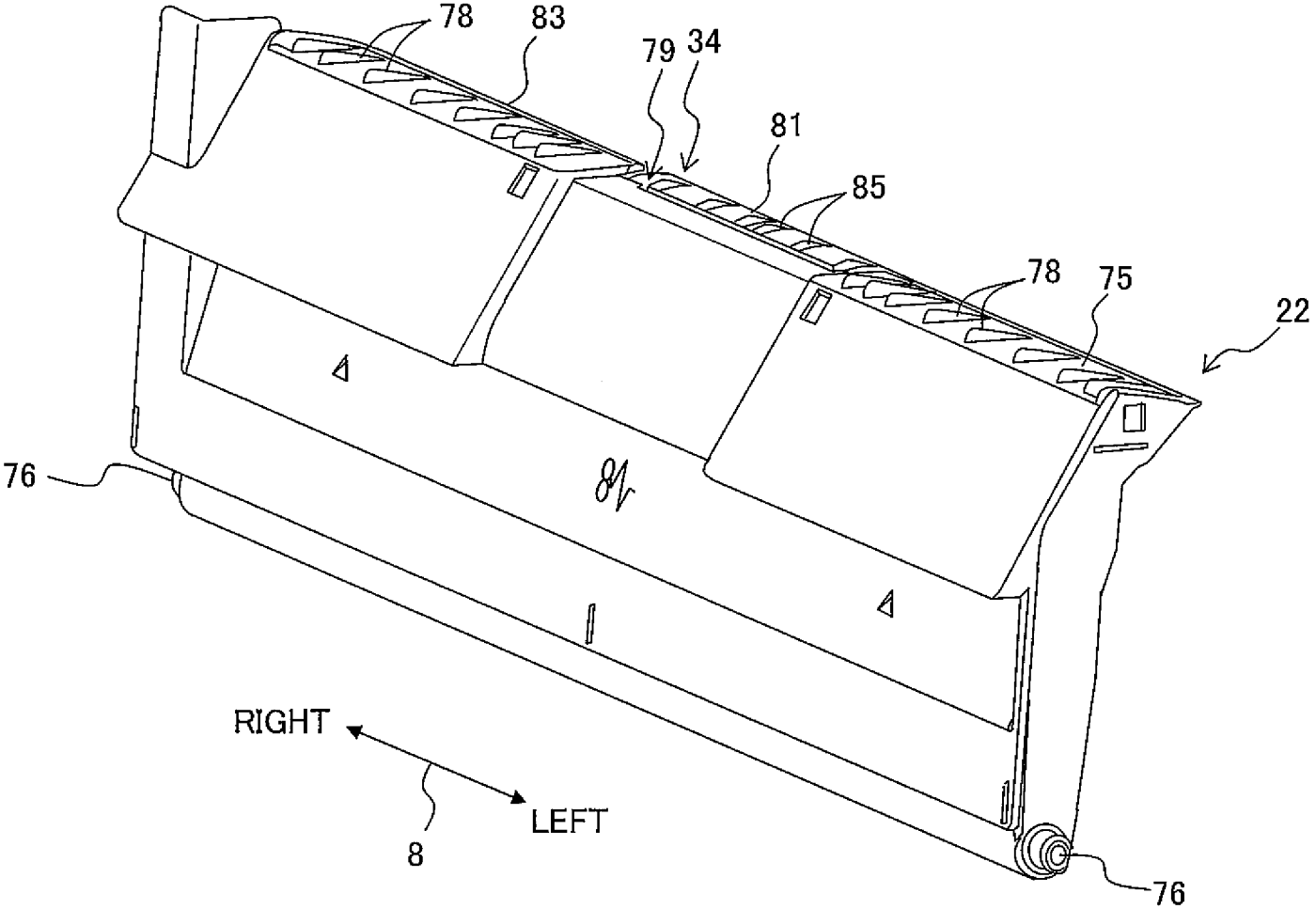
FIG. 6 is a perspective view depicting an outer side of the curvature of the guide member.

As depicted in FIGS. 5A and 5B, and FIG. 6, the guide member 22 is provided with a plurality of ribs 77 on its inner surface defining a part of the conveyance path 80. Each of the ribs 77 extends in the up-down direction 7 in a state that the guide member 22 is in the stand-up state. The plurality of ribs 77 are arranged on the guide member 22 at intervals along the left-right direction 9. Among the plurality of ribs 77, ribs 77A arranged in the central part with respect to the left-right direction 9 are longer than the other ribs 77 in terms of the projective length toward inner side of the curvature, i.e., toward the outer guide member 18.

The guide member 22 is provided with a plurality of ribs 78 on an upper surface 75 defining a part of the bypass path 66. Each of the ribs 78 extends in the front-rear direction 8 in the state that the guide member 22 is in the stand-up state. The plurality of ribs 78 are arranged on the upper surface 75 of the guide member 22 at intervals along the left-right direction 9.

The upper surface 75 of the guide member 22 is provided with a recess 79 formed downward in the up-down direction 7 at central portion in the left-right direction 9 thereof. The recess 79 of the guide member 22 is provided with a guide member 34. The guide member 34 is shorter than the guide member 22 in the stand-up state with respect to the up-down direction 7 and the left-right direction 9. The guide member 34, together with the guide member 22, defines a part of the conveyance path 80 on the outer side of the curvature and a part of the bypass path 66 on the lower side. The guide member 34 corresponds to the third guide member.

The guide member 34 is pivotably supported by the guide member 22. When the guide member 22 is in the stand-up state, the guide member 34 is pivotable with an upstream side in the conveyance direction of the recording sheet placed on the feed cassette 30, i.e. the lower side in the up-down direction 7 as its base end side, i.e., and with the upper side in the up-down direction 7 as a pivot front-end side. A pivot front-end 81 of the guide member 34 projects farther than an end 83 of the guide member 22. That is, as depicted in FIGS. 5A and 5B, and FIG. 7, in a state that the guide member 22 is in the stand-up state, the pivot front-end 81 of the guide member 34 is positioned closer to the first conveyance roller 60 than an end portion 83 of the guide member 22. Further, the pivot front-end 81 of the guide member 34 is positioned farther from the first conveyance roller 60 than an end portion 86 of the outer guide member 18. The end portion 83 of the guide member 22 corresponds to the first pivot front-end and the end portion 81 of the guide member 34 corresponds to the second pivot front-end.

Both ends of the guide member 34 in the left-right direction 9 overlap with a part of the guide member 22 and, by abutting against the guide member 22, the pivotable range of the guide member 34 is restricted. When the guide member 22 is in the stand-up state, the guide member 34 is pivotable between an inner position (see FIGS. 7 and 10) at which the pivot front-end 81 is positioned at inner side of the curvature, and an outer position (see FIGS. 8 and 10) at which a distance d2 from the pivot front-end 81 to the shafts 76 of the guide member 22 is longer than a distance d1 from the pivot front-end 81 at the inner position to the shafts 76 of the guide member 22. When the guide member 22 is in the stand-up state, if no eternal force is applied to the guide member 34, then due to the self-weight of guide member 34, the pivot front-end 81 of the guide member 34 abuts against the outer guide member 18. In other words, at the inner position, the pivot front-end 81 of the guide member 34 is mounted on the outer guide member 18. When the guide member 22 is in the stand-up state, with respect to the guide member 34, the outer position corresponds to the fourth position, whereas the inner position corresponds to the third position.

The guide member 34 has a curved shape similar to the upper side of the guide member 22 in the stand-up state. A plurality of ribs 84 are arranged on the inner side of the curved shape of the guide member 34 at intervals along the left-right direction 9. Each of the ribs 84 extends along the conveyance direction of the recording sheet conveyed from the feed cassette 30. The surface formed by front-ends of the plurality of ribs 84 corresponds to the first surface.

A plurality of ribs 85 are arranged, at intervals along the left-right direction 9, on the outer side of the curved shape of the guide member 34 at positions corresponds to the upper surface 75 of the guide member 22. Each of the ribs 85 extends along the conveyance direction of the recording sheet conveyed from the bypass tray 70. The surface formed by front-ends of the plurality of ribs 85 corresponds to the second surface.

<Operations of the Printer Unit 11>

Operations of the printer unit 11 when using the feed tray 20, the feed cassette 30 and the bypass tray 70 respectively will be described below.

When the bypass tray 70 is not used, as depicted in FIG. 1, the movable portion 69 is set to the stand-up state. By virtue of this, because the movable portion 69 has a smaller projected area in planar view, it is possible to reduce the space at the rear side of the multifunction peripheral 10. Further, the tray cover 94 is pivoted to such a position as to close the upper end opening of the bypass tray 70. If there is sufficient space at the rear side of the multifunction peripheral 10, then even when the bypass tray 70 is not used, the movable portion 69 may stay in the lie-down state as it is.

When the feed tray 20 is used, the recording sheet of a desired size is set in the feed tray 20. In particular, a plurality of recording sheets are placed on the feed tray in a stacked state. The feed tray 20 on which the recording sheets are placed is inserted into the casing 14 through the opening 13 to come into an installed state. In this state, the feed roller 25 contacts with the topmost recording sheet of the plurality of recording sheets placed on the feed tray 20. Then, the feed unit 15 feeds the recording sheet from the feed tray 20, based on an input from the user, print data, or the like.

On accepting an instruction to start a print, the printer unit 11 drives the undepicted motors to rotate the feed roller 25, the first conveyance roller pair 54, and the second conveyance roller pair 55, respectively, at a predetermined timing. On receiving the rotation of the feed roller 25, the topmost recording sheet is fed along the conveyance path 65 from the feed tray 20. The recording sheet is fed along the curved pathway 65A of the conveyance path 65 to reach the first conveyance roller pair 54. The ink droplets are ejected from the recording head 39 to record a desired image on the recording sheet conveyed to the recording unit 24 while being nipped by the first conveyance roller pair 54. The recording sheet on which the image has been recorded is then nipped by the second conveyance roller pair 55 and conveyed along the straight pathway 65B to be discharged on the discharge tray 21.

When the feed cassette 30 is used, recording sheet 100 of a desired size is set in the feed cassette 30. Then, the feed unit 36 feeds the recording sheet 100 from the feed cassette 30, based on an input from the user, print data, or the like.

On accepting an instruction to start a print, the printer unit 11 drives the undepicted motors to rotate the feed roller 45, the first conveyance roller pair 54, and the second conveyance roller pair 55, respectively, at a predetermined timing. On receiving the rotation of the feed roller 45, the topmost recording sheet 100 is fed along the conveyance path 80 from the feed cassette 30.

In the conveyance path 80, the recording sheet 100 is guided along the ribs 77 and 77A of the guide member 22 until the front end of the recording sheet 100 reaches the guide member 34. As depicted in FIG. 7, in a state that the front end of the recording sheet 100 does not contact with the guide member 34, the guide member 34 is situated at the inner position due to its own weight. As depicted in FIG. 8, if the front end of the recording sheet 100 contacts with the guide member 34 at the inner position, and the recording sheet 100 is further conveyed, then the guide member 34 at the inner position is pushed upward to pivot to the outer position.

The recording sheet 100 is guided along the ribs 84 of the guide member 34 at the outer position until reaching the first conveyance roller pair 54. The ink droplets are ejected from the recording head 39 to record a desired image on the recording sheet 100 conveyed to the recording unit 24 while being nipped by the first conveyance roller pair 54. The recording sheet 100 on which the image has been recorded is then nipped by the second conveyance roller pair 55 and conveyed along the straight pathway 65B to be discharged on the discharge tray 21.

When the bypass tray 70 is used, the movable portion 69 is set to the inclined state. Further, the tray cover 94 is pivoted to the position at which the opening of the bypass tray 70 at the upper end side is exposed. A plurality of recording sheets are placed on the support surface 90 of the bypass tray 70 in a stacked state.

On accepting an instruction to start a print, the printer unit 11 drives the undepicted motors to rotate a feed roller (not depicted) of the bypass tray 70, the first conveyance roller pair 54, and the second conveyance roller pair 55, respectively, at a predetermined timing. On receiving the rotation of the feed roller, the topmost recording sheet is fed along the bypass path 66 from the bypass tray 70.

The recording sheet fed along the bypass path 66 is guided along the ribs 85 of the guide member 34 at the inner position and, furthermore, conveyed from the bypass path 66 along the straight pathway 65B of the conveyance path 65 until reaching the first conveyance roller pair 54. Because the pivot front-end 81 of the guide member 34 at the inner position is supported by the outer guide member 18, even if the recording sheet conveyed along the bypass path 66 slides to contact with the guide member 34, the guide member 34 does not further pivot from the inner position to the inner side of the curvature. The ink droplets are ejected from the recording head 39 to record a desired image on the recording sheet conveyed to the recording unit 24 while being nipped by the first conveyance roller pair 54. The recording sheet on which the image has been recorded is then nipped by the second conveyance roller pair 55 and conveyed along the straight pathway 65B to be discharged on the discharge tray 21.

<Opening of the Conveyance Path 80>

The operation of opening the conveyance path 80 will be described below. When a paper jam occurs in the conveyance path 80 or when maintenance is needed, the conveyance path 80 is opened.

Figure 10:
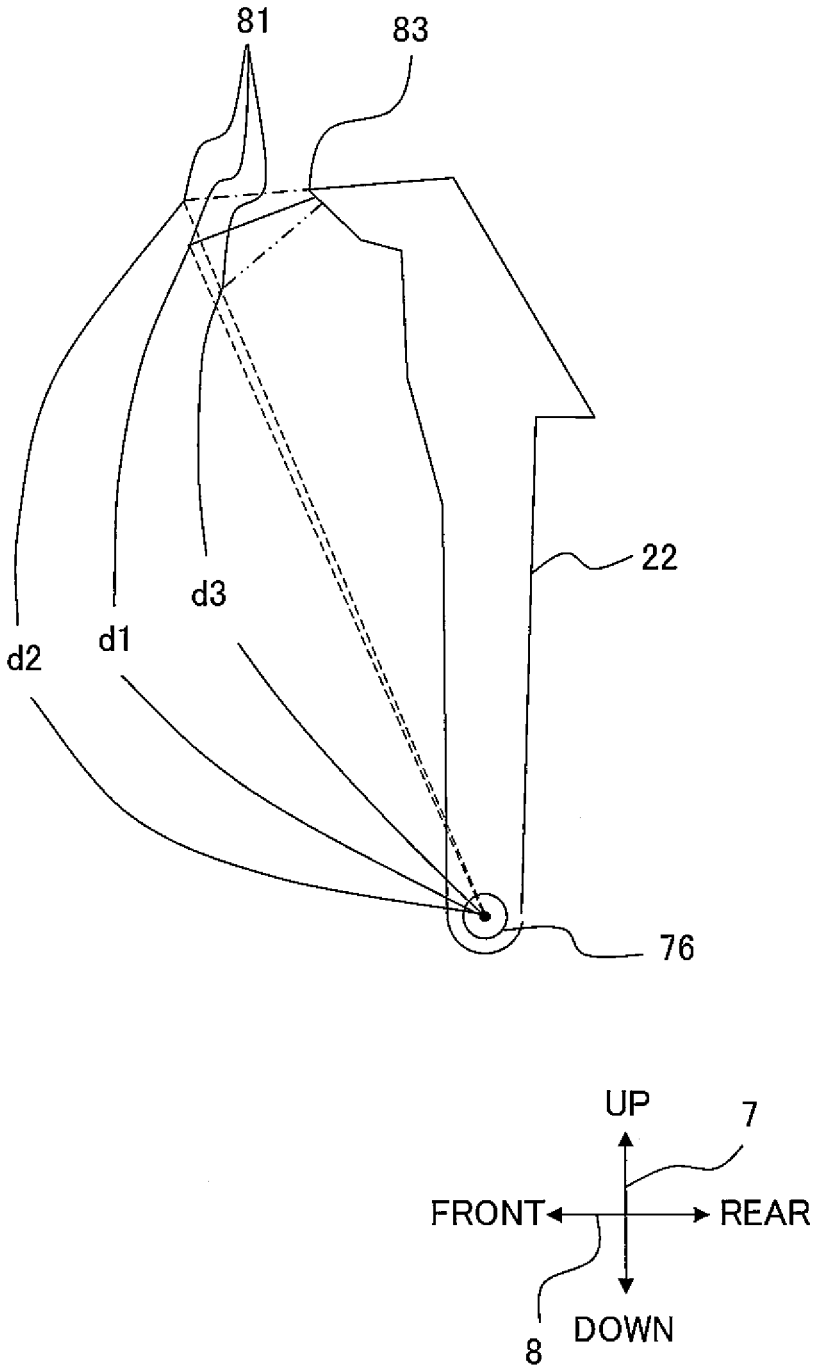
FIG. 10 is a side view depicting how the guide member rotates.

As depicted in FIG. 7, in the state that the guide member 22 is in the stand-up state, the guide member 34 is situated at the inner position due to its own weight. As depicted in FIG. 9, as the guide member 22 in the stand-up state is pivoted around the shafts 76, the pivot front-end 81 of the guide member 34 is separated from the outer guide member 18. As a result, the guide member 34 further pivots around the shafts 76 to the inner side of the curvature until a contact surface 87 of the guide member 34 on the opposite side to the pivot front-end 81 pivots to a pivotable limit defined by abutting against the guide member 22. That is, the pivot front-end 81 of the guide member 34 comes to be situated further at inner side of the curvature from the inner position when the guide member 22 is in the stand-up state, that is, from the position at which the guide member 34 is mounted on the outer guide member 18. In this manner, the pivot front-end 81 of the guide member 34 is situated at the most inner side of the curvature, thereby rendering the shortest distance from the shafts 76 of the guide member 22 to the position at which the guide member 34 is separated farther in a radial direction, that is, rendering the shortest radius of the trajectory for the guide member 34 to pivot around the shafts 76. The guide member 34 with the pivot front-end 81 at the ultimate inner position is pivoted together with the guide member 22 in such a direction as to open the conveyance path 80, without contact with the bypass tray 70. Such a position corresponds to the fifth position that the pivot front-end 81 of the guide member 34 is situated at the ultimate inner side and, as depicted in FIG. 10, a distance d3 from the pivot front-end 81 to the shafts 76 of the guide member 22 is shorter than the distance d1 from the pivot front-end 81 at the inner position to the shafts 76 of the guide member 22.

When the guide member 22 is pivoted from the lie-down state to the stand-up state, the guide member 34 with the pivot front-end 81 at the ultimate inner position causes the pivot front-end 81 to contact with the outer guide member 18. In this state, if the guide member 22 is pivoted up to the stand-up state, then the guide member 34 is pivoted from the ultimate inner position to the position at which the pivot front-end 81 is mounted on the outer guide member 18 as depicted in FIG. 7 while causing the pivot front-end 81 to slide on the outer guide member 18.

[Effect of the Embodiment]

According to the above embodiment, the guide member 34 is provided pivotably at the pivot front-end of the guide member 22 and, by the pivot front-end 81 of the guide member 34, the recording sheet 100 is guided to the downstream side in the conveyance direction from the end 83 of the guide member 22. Further, when the guide member 22 is pivoted from the stand-up state to the lie-down state, the guide member 34 is situated at the inner position, thereby shortening the trajectory for the guide member 34 to pivot therethrough around the shafts 76. By virtue of this, it is possible to shorten the trajectory for the guide members 22 and 34 to pivot therethrough while lowering the influence on conveyance of the recording sheet 100.

Further, in the guide member 34, the ribs 84 guide the recording sheet 100 supplied from the feed cassette 30, and the ribs 85 guide the recording sheet supplied from the bypass tray 70. Hence, the guide member 34 functions as the guide surface for each of the conveyance path 80 and the bypass path 66.

Further, by arranging the guide member 34 in a part of the central portion of the guide member 22 in the left-right direction 9, it is possible to downsize the guide member 34 and facilitate reduction of its weight, thereby enabling the guide member 34 to be easily pivoted.

Further, because the ribs 77A arranged in the central portion of the guide member 22 in the left-right direction 9 project toward the outer guide member 18 further than the other ribs 77, the central part of the recording sheet 100 in the left-right direction 9, which contacts with the guide member 34, is mainly guided to the guide member 34 by the ribs 77A.

Further, the pivot front-end 81 of the guide member 34 is located closer to the first conveyance roller 60 than the end portion 83 of the guide member 22. Therefore the recording sheet 100 contacts with the first conveyance roller 60 constantly at the same position.

Further, when the guide member 22 in the stand-up state is pivoted to the lie-down state, the pivot front-end 81 of the guide member 34 separates from the outer guide member 18, and pivots from the position at which the pivot front-end 81 contacts with the outer guide member 18 to the further inner position located inside of the curvature, thereby further shortening the trajectory for the guide member 22 to pivot therethrough.

What is claimed is:

1. An image recording apparatus comprising:

a first tray on which a sheet is to be placed;

a case in which a first conveyance path is formed, the first conveyance path including a curved portion curved upward from the first tray and an extended portion connected to the curved portion;

a feed roller configured to feed the sheet from the first tray along the first conveyance path in a conveyance direction;

a conveyance roller arranged at downstream side of the feed roller in the conveyance direction in the first conveyance path, and configured to convey the sheet;

a recording unit arranged at downstream side of the conveyance roller in the conveyance direction in the first conveyance path, and configured to record an image on the sheet conveyed through the extended portion of the first conveyance path;

a first guide member arranged at upstream side of the conveyance roller in the conveyance direction, configured to define an outside of the curved portion of the first conveyance path, and configured to be pivotable between a first position at which the curved portion is defined by the first guide member and a second position at which the curved portion is opened by the first guide member, with an upstream side portion in the conveyance direction thereof as a first pivot shaft and with a downstream side portion in the conveyance direction thereof as a first pivot front-end;

a second guide member configured to define an inside of the curved portion of the first conveyance path; and a third guide member provided for the first guide member at a position on a side of the first pivot front-end, configured to be pivotable between a third position and a fourth position, and having a second pivot front-end projecting in the conveyance direction from the first pivot front-end of the first guide member, wherein in a state that the third guide member is positioned at the third position, the second pivot front-end is positioned at an inner side of a curvature with respect to the first guide member, a distance from the second pivot front-end to the first pivot shaft in a state that the third guide member is positioned at the fourth position is longer than a distance from the second pivot front-end to the first pivot shaft in the state that the third guide member is positioned at the third position, the third guide member is arranged in such a part of the first guide member as to extend in a widthwise direction orthogonal to the conveyance direction, the first guide member is provided with a plurality of ribs projecting toward the second guide member and extending along the conveyance direction, and each rib provided in a location corresponding to the third guide member in the widthwise direction projects toward the second guide member longer than other ribs provided in locations arranged at both sides, of the location corresponding to the third guide member, in the widthwise direction.

2. The image recording apparatus according to claim 1, further comprising:

a second tray on which another sheet is to be placed; and a second conveyance path provided in the case to extend from the second tray and to be connected to the first conveyance path at upstream side of the conveyance roller in the conveyance direction, wherein the third guide member is configured to guide the sheet fed from the first tray by a first surface facing to the inner side of the curvature with respect to the first guide member, and to guide the another sheet fed from the second tray by a second surface facing to an outer side of the curvature with respect to the first guide member.

3. The image recording apparatus according to claim 1, wherein the third guide member is configured such that the second pivot front-end is positioned in the vicinity of the conveyance roller in a state that the first guide member is positioned at the first position.

4. The image recording apparatus according to claim 1, wherein in a state that the first guide member is positioned at the first position, the third guide member is maintained at the third position by the second pivot front-end abutting against the second guide member, under a condition that the first guide member is pivoted from the first position to the second position and the second pivot front-end is separated from the second guide member, the third guide member is configured to pivot from the third position to a fifth position, and a distance from the second pivot front-end to the first pivot shaft in a state that the third guide member is positioned at the fifth position is shorter than the distance from the second pivot front-end to the first pivot shaft in the state that the third guide member is positioned at the third position.

5. An image recording apparatus comprising:

a first tray on which a sheet is to be placed;

a case in which a first conveyance path is formed, the first conveyance path including a curved portion curved upward from the first tray and an extended portion connected to the curved portion;

a feed roller configured to feed the sheet from the first tray along the first conveyance path in a conveyance direction;

a conveyance roller arranged at a downstream side of the feed roller in the conveyance direction in the first conveyance path, and configured to convey the sheet;

a second tray on which another sheet is to be placed;

a second conveyance path provided in the case to extend from the second tray and to be connected to the first conveyance path at upstream side of the conveyance roller in the conveyance direction;

a recording unit arranged at downstream side of the conveyance roller in the conveyance direction in the first conveyance path, and configured to record an image on the sheet conveyed through the extended portion of the first conveyance path;

a first guide member arranged at upstream side of the conveyance roller in the conveyance direction, configured to define an outside of the curved portion of the first conveyance path, and configured to be pivotable between a first position at which the curved portion is defined by the first guide member and a second position at which the curved portion is opened by the first guide member, with an upstream side portion in the conveyance direction thereof as a first pivot shaft and with a downstream side portion in the conveyance direction thereof as a first pivot front-end;

a second guide member configured to define an inside of the curved portion of the first conveyance path; and a third guide member provided for the first guide member at a central portion in a widthwise direction orthogonal to the conveyance direction on a side of the first pivot front-end, configured to be pivotable between a third position and a fourth position, and having a second pivot front-end projecting in the conveyance direction from the first pivot front-end of the first guide member;

wherein in a state that the third guide member is positioned at the third position, the second pivot front-end is positioned at an inner side of a curvature with respect to the first guide member, a distance from the second pivot front-end to the first pivot shaft in a state that the third guide member is positioned at the fourth position is longer than a distance from the second pivot front-end to the first pivot shaft in the state that the third guide member is positioned at the third position, the third guide member is shorter than the first guide member in the widthwise direction, and wherein the third guide member is configured to guide the sheet fed from the first tray by a first surface facing to the inner side of the curvature with respect to the first guide member, and to guide the another sheet fed from the second tray by a second surface facing to an outer, side of the curvature with respect to the first guide member.

6. The image recording apparatus according to claim 5, wherein the first guide member is provided with a plurality of ribs projecting toward the second guide member and extending along the conveyance direction, and each rib provided in a location corresponding to the third guide member in the widthwise direction projects toward the second guide member longer than other ribs provided in locations arranged at both sides, of the location corresponding to the third guide member, in the widthwise direction.

7. The image recording apparatus according to claim 5, wherein the third guide member is configured such that the second pivot front-end is positioned in the vicinity of the conveyance roller in a state that the first guide member is positioned at the first position.

8. The image recording apparatus according to claim 5, wherein in a state that the first guide member is positioned at the first position, the third guide member is maintained at the third position by the second pivot front-end abutting against the second guide member, under a condition that the first guide member is pivoted from the first position to the second position and the second pivot front-end is separated from the second guide member, the third guide member is configured to pivot from the third position to a fifth position, and a distance from the second pivot front-end to the first pivot shaft in a state that the third guide member is positioned at the fifth position is shorter than the distance from the second pivot front-end to the first pivot shaft in the state that the third guide member is positioned at the third position.

* * * * *